US006359266B2

(12) United States Patent
Little et al.

(10) Patent No.: US 6,359,266 B2
(45) Date of Patent: Mar. 19, 2002

(54) FLICKER FREE FUSER CONTROL

(75) Inventors: Daniel B. Little, Bloomfield; Robert S. Foley, Rochester, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/739,721

(22) Filed: Dec. 18, 2000

Related U.S. Application Data

(63) Continuation-in-part of application No. 09/374,295, filed on Aug. 16, 1999, now abandoned.

(51) Int. Cl.[7] ..... G03G 13/20; H05B 1/02

(52) U.S. Cl. ..... 219/501; 219/216; 399/335; 315/309

(58) Field of Search ..... 219/501, 216, 219/494, 492, 497; 315/307, 309; 323/282; 399/335, 336

(56) References Cited

U.S. PATENT DOCUMENTS

| | | | | | |
|---|---|---|---|---|---|
| 3,579,096 | A | * | 5/1971 | Buchanan, Jr. | 323/22 SC |
| 3,735,092 | A | * | 5/1973 | Traister | 219/501 |
| 3,881,085 | A | * | 4/1975 | Traister | 219/216 |
| 3,961,236 | A | * | 6/1976 | Rodek et al. | 323/18 |
| 4,223,207 | A | * | 9/1980 | Chow | 219/494 |
| 4,731,722 | A | * | 3/1988 | Conroy | 323/207 |
| 4,894,520 | A | * | 1/1990 | Moran | 219/497 |
| 4,902,958 | A | * | 2/1990 | Cook, II | 323/282 |
| 5,207,520 | A | * | 5/1993 | Tanaka | 388/804 |
| 5,475,202 | A | * | 12/1995 | Schallis | 219/497 |
| 5,986,241 | A | * | 11/1999 | Funahashi | 219/497 |
| 6,020,729 | A | * | 2/2000 | Stratakos et al. | 323/283 |

FOREIGN PATENT DOCUMENTS

| | | | |
|---|---|---|---|
| DE | 3330990 | * | 3/1984 |
| JP | 11-87049 | * | 3/1999 |

* cited by examiner

*Primary Examiner*—John A. Jeffery
(74) *Attorney, Agent, or Firm*—Lloyd Bean, II

(57) ABSTRACT

A control system for delivering a constant fuser temperature despite variations in the line voltage is effected by a control circuit which employs closed loop feedback control to control the rms voltage across the load. This is accomplished by a circuit and method which functionally provides a continuous solution to the equation which describes the relationship between the temperature of the fuser and the temperature of a desired control setpoint. Briefly, the solution of this equation is obtained by monitoring, i.e. sampling, the temperature of the fuser, subtracting the desired control temperature, and then integrating the difference over time. The resultant time integral is used to control the operating point of a pulse width modulated power controller. The integrator has a time constant sufficiently long and the power controller operates at a frequency sufficiently high so as to render lighting flicker imperceptible. The control circuit is particularly advantageous in controlling the rms voltage across a radiant fuser lamp in an electrostatographic printing machine.

6 Claims, 7 Drawing Sheets

FLICKER FREE FUSER CONTROL

This application is a continuation-in-part of application Ser. No. 09/374,295, filed Aug. 16, 1999 abandoned.

BACKGROUND OF THE INVENTION

AND

SUMMARY OF THE INVENTION

The present invention relates generally to the power regulating and electrostatographic printing arts. More particularly, the invention concerns an rms voltage controller for ensuring constant fuser temperature by controlling the power dissipation of a fixed load. While the specific intention is to control a fuser, the same techniques may be applied to any high current load where line voltage variations cause flicker.

In a preferred form, a controller in accordance with the invention is advantageously employed to control the rms voltage supplied to a fusing apparatus of an electrostatographic printing machine. In the process of xerography, an exemplary form of electrostatographic printing, heat is applied to permanently affix powder toner images to a variety of support surfaces, such as individual copy sheets. This process of applying heat is conventionally referred to as fusing and is carried out by a fusing apparatus, or simply a fuser. A resistance element, such as a lamp, is typically employed to generate the heat necessary for the fusing process. To maintain a consistent level of copy quality, it is necessary to maintain the temperature of the fuser within a critical tolerance range. If the fuser temperature is too low, fusing of the powder images may be incomplete, producing smeared or incompletely copied final images. Fuser temperatures which are too high raise the likelihood that the copy sheets may scorch or bum. The sources to which printing machines are connected, a separate isolated voltage source typically 115 volts AC, exhibit inevitable variations in the line voltage supplied. A separate isolated circuit is usually employed to prevent lighting flicker due to the load current variations generated by the electrostatographic printing machine's fuser controller.

An objective to the present invention is to eliminate the light flickering problem so that electrostatographic printing machine can be connected to a common circuit thereby avoiding the cost and problems associated with providing a separate circuit for the electrostatographic printing machine.

In recognition of these voltage fluctuations, a variety of regulating devices have been heretofore developed. For instance, it is known in the prior art to control the power input to the fuser in response to voltage levels across the fuser heat source. U.S. Pat. No. 3,881,085 to Traister, discloses a fuser control circuit in which a switching means, such as a silicon controlled rectifier is triggered to interrupt power to the fuser heating source when a preset level of line voltage is detected across the heating element. Separate R/C circuitry is used to set and reset an amplifier to selectively inhibit the silicon controlled rectifier and thus interrupt power supply to the heating element. Another prior art control system is shown in U.S. Pat. No. 3,735,092 to Traister. A thermistor senses changes in the fuser temperature, providing a signal which controls a switching amplifier. When a normal operating temperature is attained in the fuser, the switching amplifier is triggered to a non-conducting state which opens a switch to interrupt power to the fuser heating element. Another known class of regulating device seeks to maintain a constant power input to the fuser. In U.S. Pat. No. 3,961,236 to Rodek et al., for example, constant power regulation is sought by monitoring both the voltage across the fuser load and the current therethrough.

A summation of the detected load voltage and current provides an approximation of the power consumption which is utilized to control the power input to the fuser. To effect the desired control, a triac is selectively gated, i.e. triggered on and off, to inhibit the supply of power from the source to the fuser circuitry, the triggering being effected at zero crossing points of the supply voltage waveform for predetermined numbers of half cycles. Another illustrative circuit for regulating the power applied to a load by controlling the number of cycles of supplied voltage is shown in U.S. Pat. No. 3,579,096 to Buchanan. U.S. Pat. No. 4,223,207 to Chow discloses a circuit for controlling the power supplied to a load by varying the duty cycle of the AC signal supplied to the load. Other known control systems have been developed to regulate rms voltage across a fuser element. Since it may generally be assumed that the resistance of the fuser element will not change appreciably, it follows that control of the rms voltage across the load will effectively control the power dissipated thereby. In one such controller, a digital signal equivalent of a sample of the fuser input voltage is supplied to a processor. In response to the digitized signal, the processor selectively gates the input voltage source across the fuser heating element in accordance with a plurality of gate activation rates stored in a register associated with the processor. The foregoing controllers are either costly or do not optimally deliver accurate, precise, control of power supplied to the load. Moreover the problem with lighting flicker still remains, if these devices are connected to a common circuit.

In accordance with the invention, there is provided a control system for delivering a constant fuser temperature while reducing lighting flicker to an acceptably low level despite variations in the line voltage. In general, this is effected by a circuit which employs closed loop feedback to control the temperature of the fuser. This is accomplished by a circuit and method which functionally provides a continuous solution to the equation which describes the relationship between the temperature of the fuser and the temperature of a desired control setpoint. Briefly, the solution of this equation is obtained by monitoring, i.e. sampling, the temperature of the fuser, subtracting the desired control temperature, and then integrating the difference over time. The resultant time integral is used to control the operating point of a Pulse Width Modulated (PWM) power controller. The integrator has a time constant sufficiently long and the power controller operates at a frequency sufficiently high so as to render lighting flicker imperceptible. The control circuit of this invention is particularly advantageous in controlling the rms voltage across a radiant fuser lamp in an electrostatographic printing machine. In such an application, the circuitry preferably includes a microprocessor which controls a pulse width modulated power chain to regulate the input line voltage across the fuser heating element. In this preferred form, the fuser temperature is converted into a representative signal. The microprocessor is programmed to act as an integrator that continuously averages the difference between this sampled temperature and the predetermined control temperature. When this continuous summation equals a fixed reference, predetermined in accordance with the system equation, the microprocessor changes the pulse width modulator duty ratio, controlling the voltage applied to the load. Special care is taken to limit the rate at which the processor changes the PWM duty ratio, thereby eliminating lighting flicker.

DESCRIPTION OF THE DRAWINGS

FIG. 8 shows a circuit arrangement wherein a power source in which printing machine 10 and lighting fixtures 12 are connected to.

DETAILED DESCRIPTION OF THE PREFERRED EMBODIMENT OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
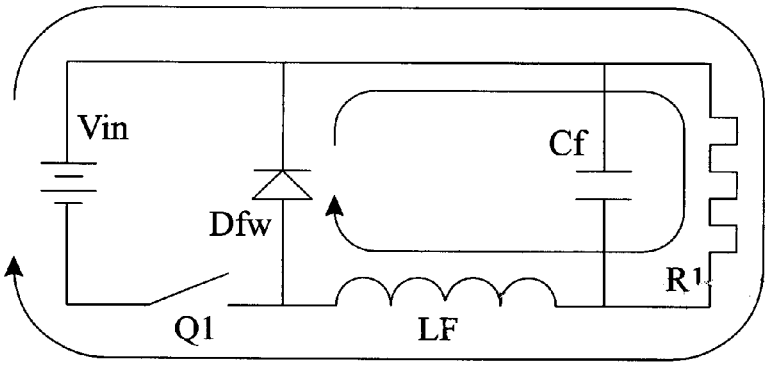
FIG. 1 is a schematic of a PWM Buck Regulator having the features of the present invention.

FIG. 1 shows the process flow of the present invention. AC line power is full-wave rectified. A buck converter power chain controls power to the fuser lamp. Heat from the fuser lamp is detected by a temperature sensor, whose signal is converted to a voltage and fed back to an error voltage generator. The error voltage generator subtracts the temperature feedback signal from the setpoint reference. The error voltage is used to control a Pulse Width Modulator, which controls the amount of power the buck converter power chain allows the fuser lamp.

Two aspects of the invention eliminate lighting flicker. First, the buck converter operates at a frequency about 35 KHz and above at which line voltage fluctuations due the converter's operation are imperceptible. Also, the error voltage generator's time response is purposely made long, insuring that the converter will gradually change its operating point over several AC line cycles, thereby eliminating flicker due to rapid control loop response.

Figure 5:
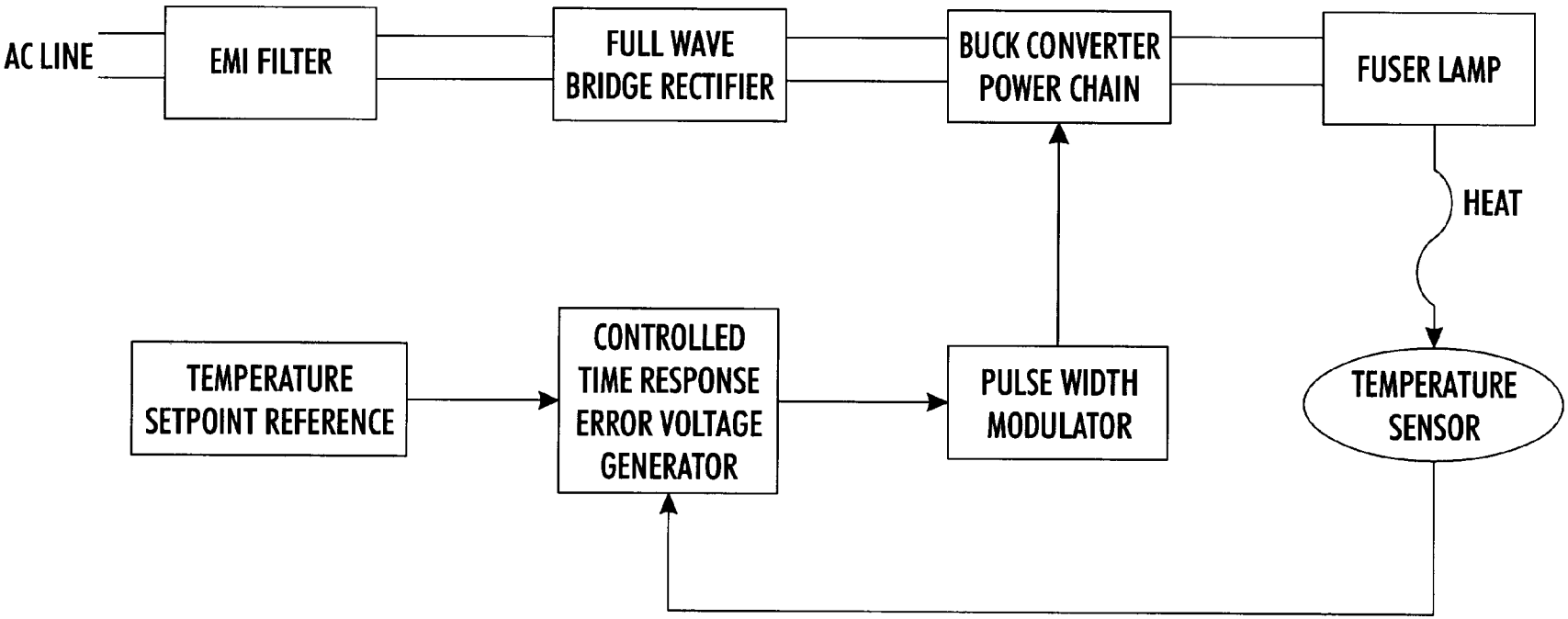
FIG. 5 is a process flow diagram of the present invention.

Referring to FIG. 5, the heart of the lamp power control is a Pulse Width Modulated buck style regulator. A simplified buck regulator is shown in FIG. 1. The output voltage is regulated by varying the switch on-time. When switch Q1 is closed, the current flow follows the solid line, flowing through the load, resistor R1 and charging filter inductor LF. When switch Q1 turns off, the magnetic field in inductor LF collapses, causing it to pump current through free-wheeling diode Dfw, thus maintaining current flow to the load. Capacitor Cf provides additional filtering.

Figure 2:
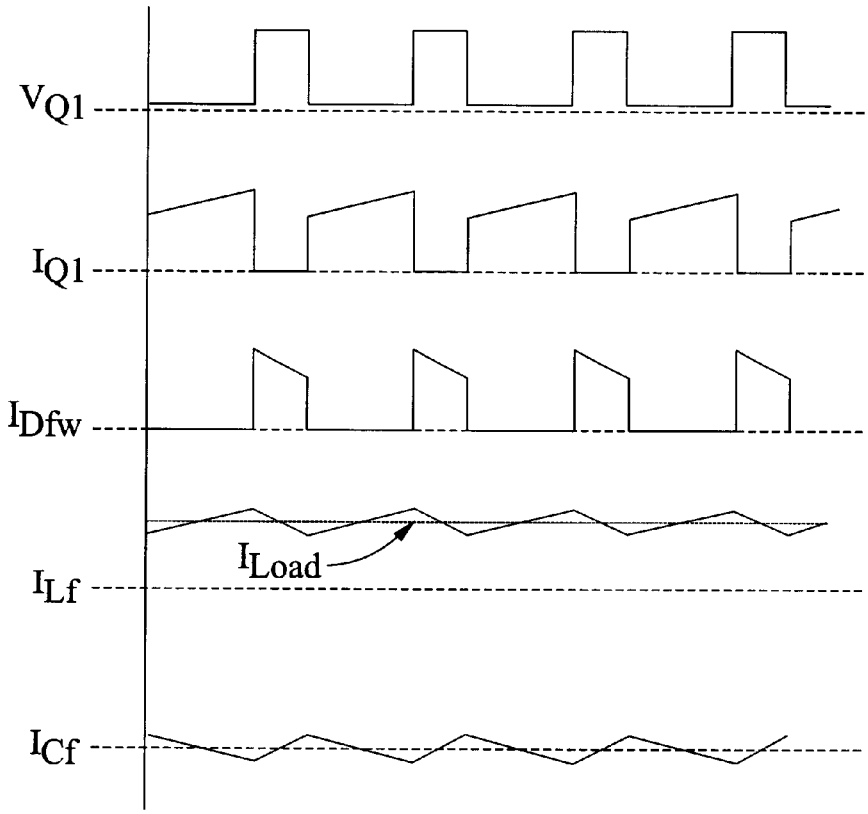
FIG. 2 are schematics of Buck Regulator Switching Waveforms.

Representative waveforms are shown in FIG. 2. The combination of inductor LF and capacitor Cf act essentially as a low pass filter, attenuating the high frequency carrier and passing only the DC average. The output voltage equals the input voltage times the switch duty ratio.

Figure 4:
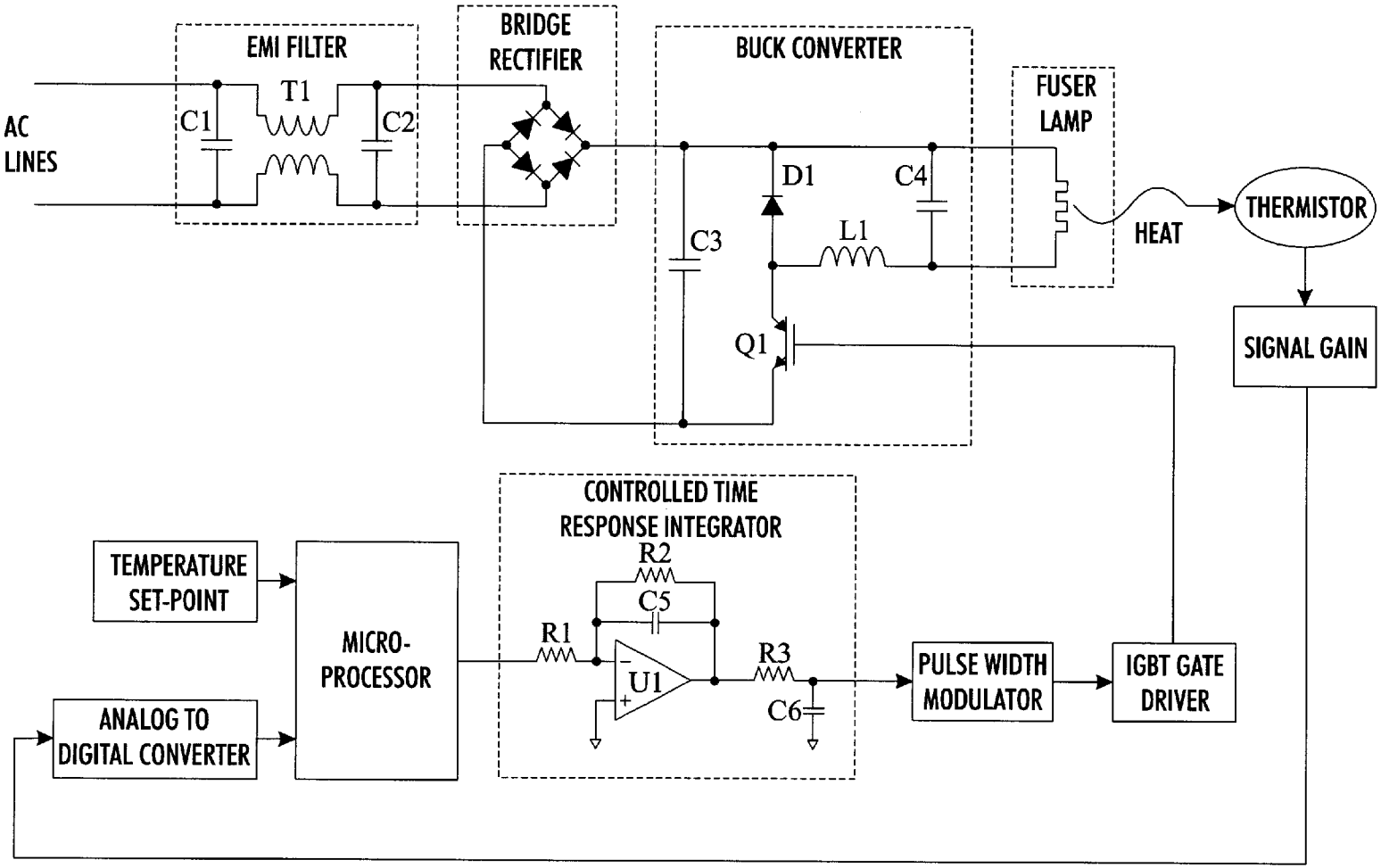
FIG. 4 is a circuit diagram of the present invention.

Referring to FIG. 4, the situation is somewhat more complicated in the present invention. Rather than a DC input voltage, the present invention power chain regulates a full-wave rectified sine wave. The basic buck regulator operation remains the same, but the output voltage is a reduced amplitude replica of the input waveform.

Figure 3:
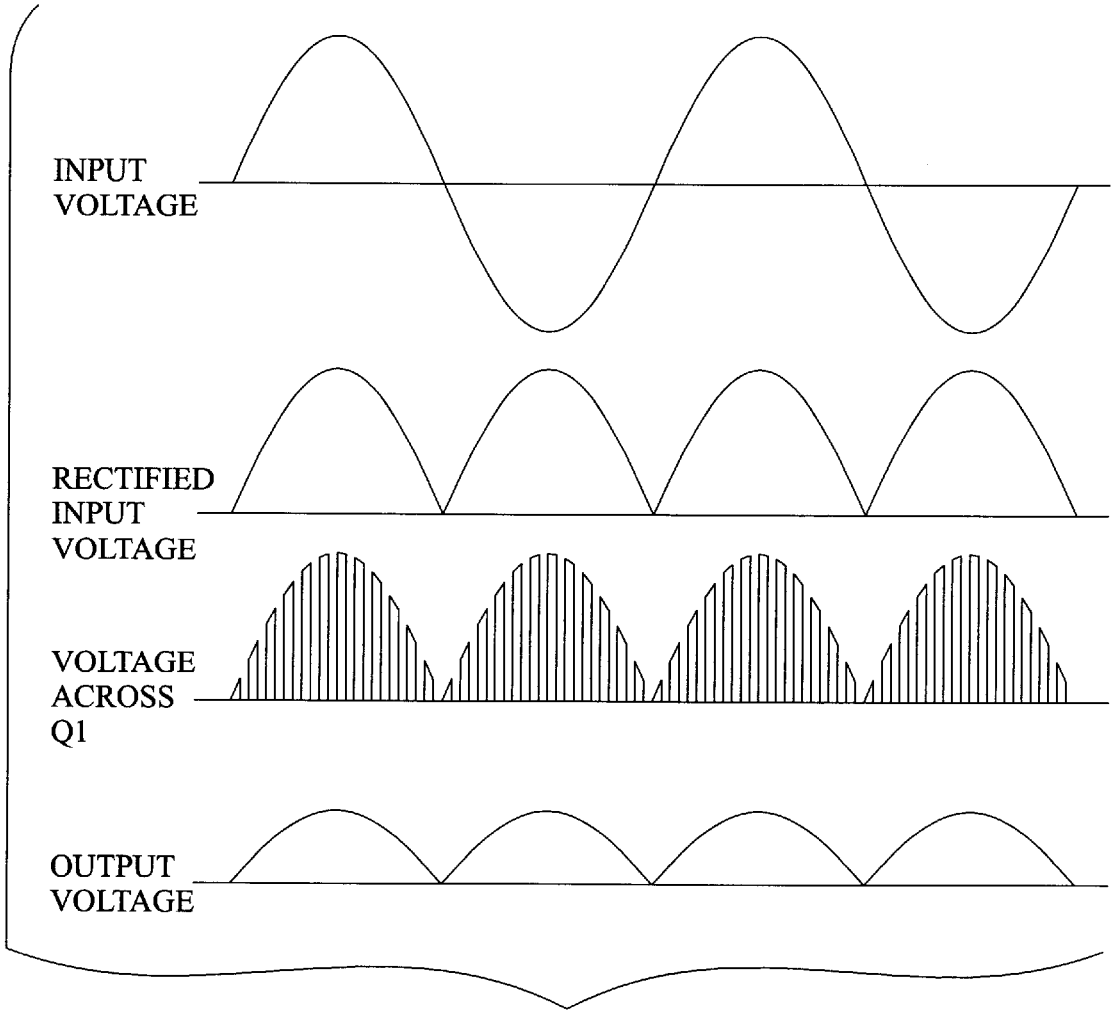
FIG. 3 are schematics of representative waveforms utilized in the present invention.

In the present invention, the switching element is an Insulated Gate Bipolar Transistor (IGBT), with a switching frequency of 35 KHz. When switch Q1 is switched on, current flows from the bridge rectifier through the fuser lamp, inductor L1, and IGBT Q1. Diode D1 is reversed biased. When switch Q1 is switched off, the magnetic field in inductor L1 collapses, pumping current out of inductor L1. Diode D1 becomes forward biased, allowing current to "flywheel" out of the inductor into the fuser lamp. The resulting output is a reduced-amplitude replica of the input waveform. The output magnitude is approximately the ratio of switch Q1's on-time to the switching period. Representative waveforms are given in FIG. 3.

Capacitor C3 provides a path for high frequency input current pulses. It is important to note that the value of capacitor C3 was chosen large enough to attenuate high frequency current pulses, but not so large as to distort the wave shape of the AC line current thereby reducing line current harmonics. The size of C3 was estimated assuming a fuser heater rated at 1900 W, 230V. When a 5 uF capacitor is chosen, the power factor will remain above 90% when the duty ratio exceeds 28%. When a 10 uF capacitor is used, the power factor will remain above 90% when the duty ratio exceeds 40%. Values of C3 lower than 5 uF result in higher conducted electromagnetic emissions.

Inductor L1 was chosen to limit the high frequency current ripple to approximately twice the instantaneous current at the worse case duty cycle of 50%. The circuit will operate at much higher duty cycles, typically over 80% during operation. During normal operation, the high frequency ripple current is limited to 40% of the instantaneous load current. Capacitor C4 provides sufficient output filtering to reduce the output voltage ripple to approximately 1% of the instantaneous load voltage. In the preferred embodiment, C4 can range between 5 uF and 20 uF.

The bridge rectifier is preceded by an EMI PI-filter consisting of capacitor C1, capacitor C2, and transistor T2. The filter prevents switching noise from the buck converter from appearing on the AC lines.

Fuser temperature is detected by the thermistor, whose output is amplified and is converted to a binary number by an Analog-to-Digital converter. The microprocessor is programmed to compare this binary number to a pre-existing temperature setpoint and generate a pulsed signal representative of the error. The pulsed signal is time averaged into a D.C. control signal by the circuitry comprised of comparator U1, resistor R1, capacitor C5 and resistor R2. resistor R3 and capacitor C6 limit the resultant signal's time rate-of-change. The D.C. control signal is fed to a Pulse Width Modulator (PWM), whose output is used to duty ratio control the Buck Converter section as previously described.

Figure 8:
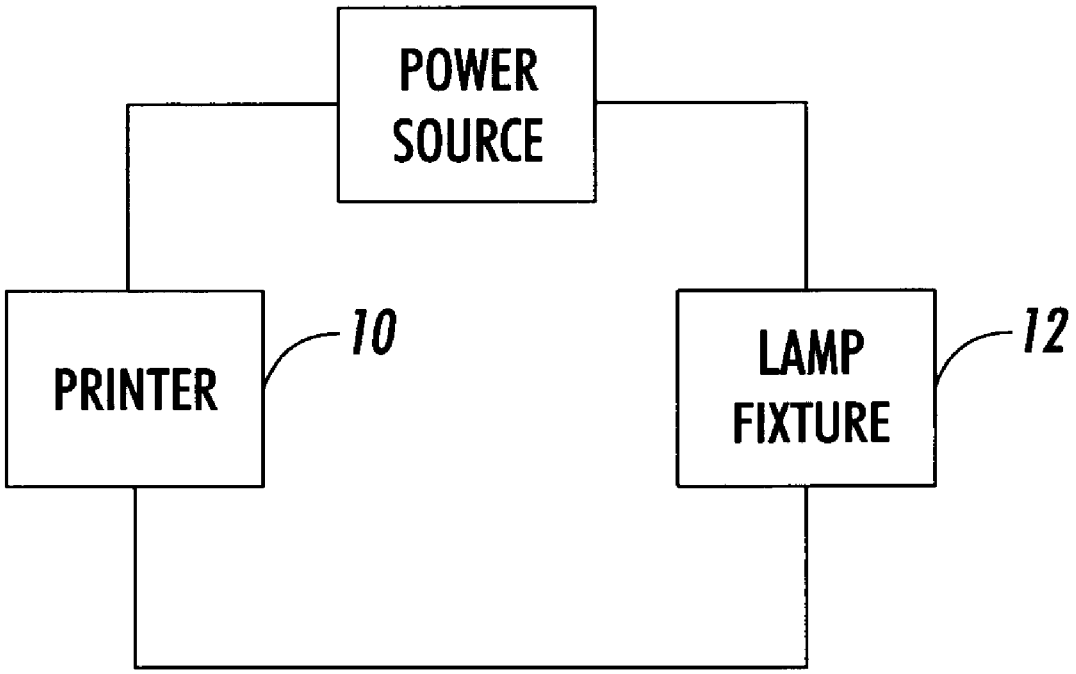

FIG. 8 shows a circuit arrangement wherein a power source in which printing machine 10 and lighting fixtures 12 are connected, to a common voltage source typically 115 volts AC. Typical, a separate isolated circuit is usually employed to prevent lighting flicker due to the load current variations generated by the electrostatographic printing machine's fuser controller.

Figure 6:
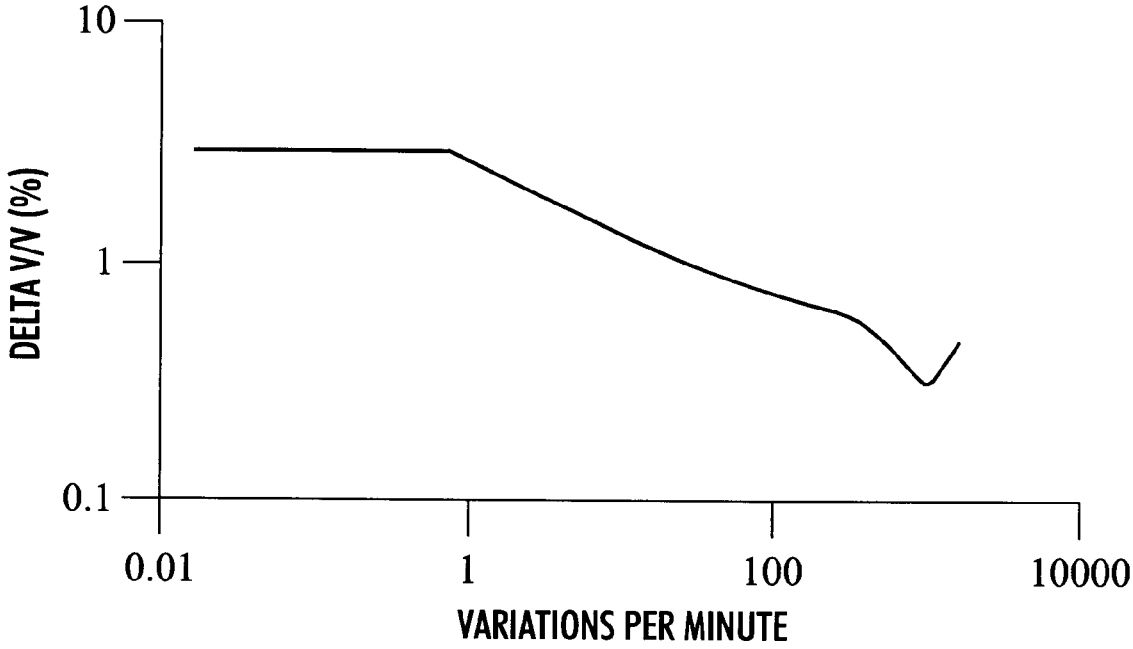
FIG. 6 is the threshold of annoyance $P_{St}$=1 curve.

Lighting flicker is the result of large current changes creating varying voltage drops across the power line impedance. The standard for regulating lighting flicker, European Standard EN61000-3-3, is based on studies of human response to varying light intensity. The standard presents a model of the human threshold of annoyance versus percent voltage change and repetition rate to measure and regulate flicker. The standard defines both short-term flicker, $P_{St}$ and long term flicker, $P_{lt}$. The model of flicker due to recurrent rectangular voltage changes is shown in FIG. 6. It is readily apparent from the model that humans are more tolerant of infrequent voltage changes than of more frequent occurrences at the same voltage. It is also apparent that flicker can be minimized by using a power control system that does not permit abrupt changes in fuser power, but rather changes the power continually and gradually. The standard uses the following equation to express non-rectangular voltage change waveforms as a flicker impression time:

$$t_f=2.3\cdot(F\cdot d_{max})^{32} \tag{3}$$

where $d_{max}$ is the relative voltage change expressed as a percentage of the nominal voltage and F is the shape factor associated with the shape of the voltage change waveform. The sum of the flicker impression times of all evaluation periods within a total interval is the basis for the $P_{St}$ evaluation. If the total time interval is $T_p$, then:

$$P_{st}=\left(\frac{\sum t_f}{T_p}\right)^{\frac{1}{3.2}} \tag{4}$$

Long-term flicker is determined by taking 12 ten minute short-term flicker measurements and applying the cubic law smoothing function below:

$$P_{lt}=\sqrt[3]{\frac{\sum_{i=1}^{N} P_{sti}^3}{N}} \tag{5}$$

The standard specifies observation times of 10 minutes for short-term flicker and 2 hours for long-term flicker. It further specifies the value of $P_{St}$ shall not exceed 1.0 and the value of $P_{lt}$ shall not exceed 0.65.

Figure 7:
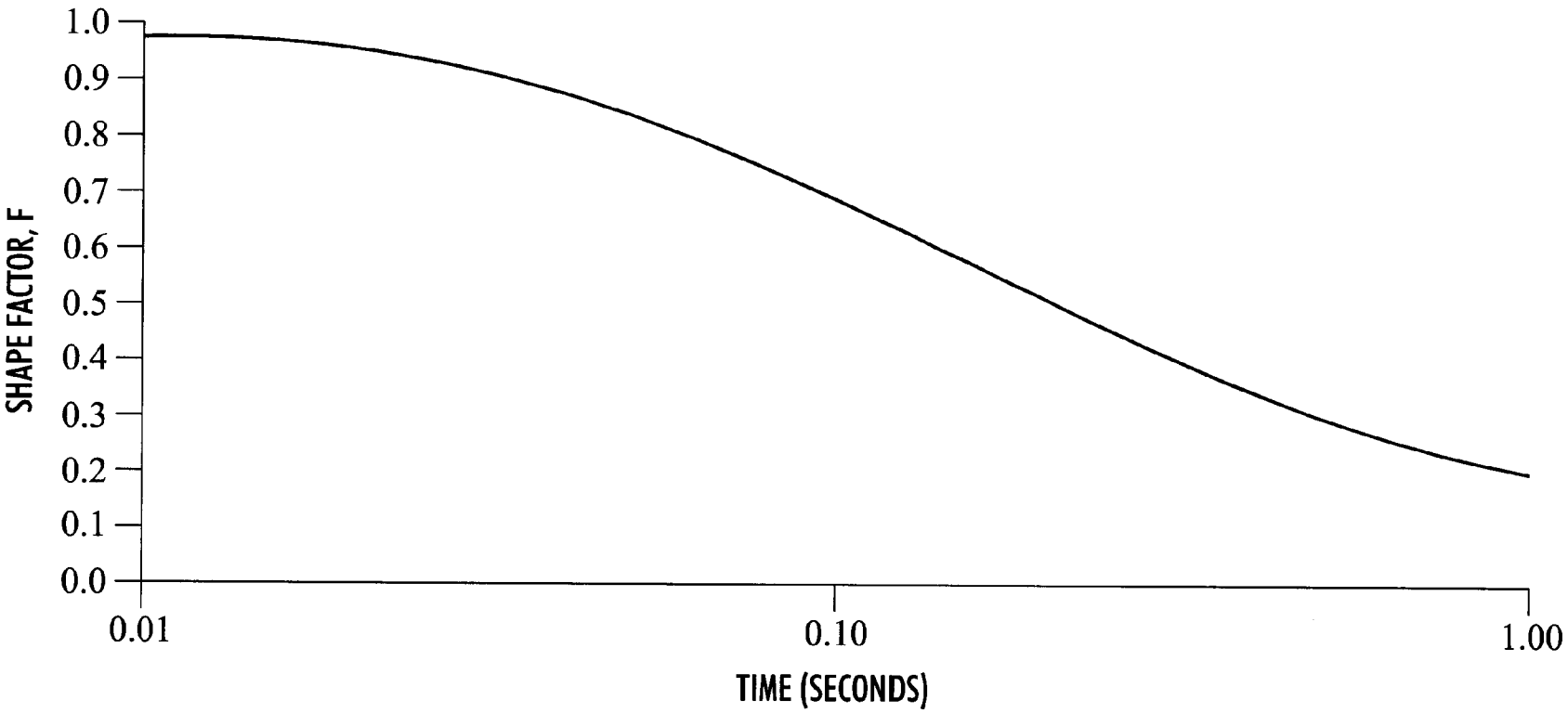
FIG. 7 shows a shape factor for the ramp waveform is of particular applicability for the present invention.

The shape factor for the ramp waveform is of particular applicability for this application and is shown in FIG. 7. The figure shows clearly that the shape factor reaches a minimum of 0.2 with a ramp duration of 1.0 second. This implies that a time constant of one second or larger would be appropriate for flicker minimization. To justify this estimation, consider a 1900 Watt fuser lamp operating on 230 Volt service, where the lamp voltage is controlled by the buck regulator as shown in FIG. 4. The output voltage of a buck regulator is directly proportional to the buck regulator duty ratio. Assume that the pulse width modulator's output duty ratio is proportional to the input voltage whose rate-of-change is controlled by the integrator. The lamp current at full scale:

$$I_{lfs}=\frac{1900\text{ W}}{230\text{ V}}=8.26\text{ A} \tag{6}$$

The lamp current response to a step input to the integrator can be derived as:

$$I_l(t)=I_{lfS}\cdot(1=e^{t/\tau}) \tag{7}$$

For the purpose of estimating worse-case flicker performance, postulate the case where the controller is switching the lamp from zero current to full on as fast as possible. With the time constant $\tau$ set at one second, the zero to full on cycle time is approximately three seconds. Once can use the standard source impedance to calculate the normalized voltage change. The source impedance is defined in the standard as $Z_S$=0.4+j0.25. The magnitude of this impedance is approximately 0.472 Ω. Therefore, the normalized voltage drop can be calculated as:

$$d_{\max}=\frac{I_{lfs}\cdot|Z_s|}{V_s}=\frac{8.26\text{ A}\cdot 0.472\ \Omega}{230\text{ V}}=1.70\% \tag{8}$$

From FIG. 7 the shape factor, F is 0.2. The flicker impression time can then be from equation (3):

$$t_f=2.3\cdot(F\cdot d_{max})^{2.3}=2.3\cdot(0.2\cdot 1.70)^{32}=0.073 \tag{9}$$

Finally, the short term flicker can be estimated from equation (4) if we assume a repetitive three-second full-off to full-on cycle:

$$P_{st}=\left(\frac{\sum t_f}{T_p}\right)^{\frac{1}{3.2}}=\left(\frac{20*0.073}{60}\right)^{1/3.2}=0.313 \tag{10}$$

This is approximately ⅓ of the specified limit and indicates the a time constant of 1 second will provide adequate flicker reduction. A lower bound for the integrator time constant of 0.3 seconds was found by a similar process. Flicker considerations alone, do not place an upper bound on the integrator time constant. An arbitrarily long integrator time constant will prevent the controller from maintaining a sufficiently stable fuser temperature. Experiments with the representative fuser system show that the fuser temperature becomes unstable with integrator time constants greater than 2.5 seconds. Therefore, 1 second was chosen as an appropriate compromise.

The resultant control equation is given below. Note that the integrator time constant is $\tau$ in the equation.

Flicker-Free Fuser Controller Equation $$V_{lamp}=V_{input}\times A_{loop}\times\frac{1}{\tau}\int_0^{\tau}(T_{setpoint}-T_{fuser})$$

where $V_{lamp}\leq V_{input}$

Variable Names:
Vlamp=Voltage across the fuser lamp
Vinput=Input line voltage
Tsetpoint=Setpoint temperature
Tfuser=Fuser temperature
Aloop=Total equivalent loop gain.
In our particular system:

$$V_{lamp}=V_{input}\times 0.2\times\int(T_{setpoint}-T_{fuser})$$

where $$V_{lamp}\leq V_{input}$$

It should be apparent to those skilled in the art that temperature dependent, controlled rate-of-change pulse width modulation could be accomplished in many ways. For example, the microprocessor could be programmed to perform not only the error signal generation, but also, the controlled time response integration and pulse width modulation as well.

It is, therefore, apparent that there has been provided in accordance with the present invention that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A control system for delivering a constant fuser temperature despite variations in the input line voltage while minimizing lighting flicker, comprising:

a microprocessor for controlling a Pulse Width Modulator to regulate the power to the fuser heater, said microprocessor includes means for converting a sample of the fuser temperature into a representative voltage signal, an integrator for summing the difference between the temperature of the fuser and a predetermined control temperature until summation equals a fixed reference, said integrator having a predefined time constant based upon human threshold of annoyance to lighting flicker; and means, responsive to integrator, for generating a signal indicative of said fixed reference to the microprocessor to adjust a duty ratio of said pulse width modulator, thereby controlling the power applied to the fuser heater.

2. The control system of claim 1, wherein said converting means includes a power source;

a full wave rectifier being connected to said power source;

a buck regulator connected to said full wave rectifier, said buck regulator and said full wave rectifier is connected to an input capacitor;

said buck regulator is connected to said load.

3. The control system of claim 2, wherein said generating means includes a controller, connected to said buck regulator, for enabling and disabling said buck regulator thereby controlling the amount of power to said load, said controller coacts with said integrator to limit the rate of change of power to said load.

4. The control system of claim 1, wherein said time constant is between 0.3 seconds and 2.5 seconds to minimize lighting flicker.

5. The control system of claim 1, wherein said Pulse Width Modulator operates at a frequency above 35 KHz.

6. A method for delivering a constant level of power to a fuser by a Pulse Width Modulated power controller despite variations in the input line voltage supplied thereto, comprising the steps:

monitoring and sampling a current temperature of the fuser, calculating voltage to deliver to the fuser, said calculating step includes subtracting the desired control temperature of the fuser from the current temperature of the fuser, and then integrating the difference over a time constant, using the resultant time integral to control a operating point of the pulse width modulated power controller as to render lighting flicker imperceptible.

* * * * *